US010299597B1

(12) United States Patent
Crum

(10) Patent No.: US 10,299,597 B1
(45) Date of Patent: May 28, 2019

(54) HIGH-LEG HIDDEN OTTOMAN RECLINER SEATING MECHANISM

(71) Applicant: L&P PROPERTY MANAGEMENT COMPANY, South Gate, CA (US)

(72) Inventor: Michael Crum, Mantachie, MS (US)

(73) Assignee: L&P PROPERTY MANAGEMENT COMPANY, South Gate, CA (US)

( * ) Notice: Subject to any disclaimer, the term of this patent is extended or adjusted under 35 U.S.C. 154(b) by 0 days.

(21) Appl. No.: 15/895,746

(22) Filed: Feb. 13, 2018

(51) Int. Cl.

| | |
|---|---|
| ***A47C 1/02*** | (2006.01) |
| ***A47C 1/022*** | (2006.01) |
| ***A47C 1/024*** | (2006.01) |
| ***A47C 1/032*** | (2006.01) |
| ***A47C 1/034*** | (2006.01) |
| ***A47C 1/035*** | (2006.01) |
| ***A47C 1/0355*** | (2013.01) |

(52) U.S. Cl.
CPC ..... *A47C 1/0355* (2013.01)

(58) Field of Classification Search
CPC ..... A47C 1/0355
USPC ..... 297/83, 84
See application file for complete search history.

(56) References Cited

U.S. PATENT DOCUMENTS 3,572,820 A * 3/1971 Ferguson ..... A47C 1/0355 297/84
3,858,932 A * 1/1975 Crum ..... A47C 1/0347 297/83 X
4,337,977 A * 7/1982 Rogers, Jr. ..... A47C 1/0355 297/85 L
4,544,201 A * 10/1985 Rogers, Jr. ..... A47C 1/0355 297/84 X
4,707,025 A * 11/1987 Rogers, Jr. ..... A47C 1/0345 297/83 X
4,815,788 A * 3/1989 May ..... A47C 1/0355 297/68 X
4,863,215 A * 9/1989 Crum ..... A47C 1/0355 297/85 L
4,878,710 A * 11/1989 Tacker ..... A47C 1/0355 297/68
4,904,019 A * 2/1990 May ..... A47C 1/0355 297/68
5,064,244 A * 11/1991 Sproule ..... A47C 1/0352 297/83 X
5,072,988 A * 12/1991 Plunk ..... A47C 1/0352 297/68

(Continued)

OTHER PUBLICATIONS

International Search Report and Written Opinion dated Feb. 14, 2019 in International Patent Application No. PCT/US2019/012689, 9 pages.

*Primary Examiner* — Rodney B White
(74) *Attorney, Agent, or Firm* — Shook Hardy & Bacon, LLP

(57) ABSTRACT

A mechanism is provided for a seating unit that moves the seating unit between closed, TV, and fully reclined positions. The mechanism allows positively holds a footrest in a closed position, preventing the footrest from sagging over time. The mechanism includes a linkage that forces a link connected to the footrest to move initially upwards as the footrest moves from a closed position to an extended position. The weight of the mechanism holds the footrest positively closed, until a force is exerted that is great enough to move past the point where the link on connected to the footrest can descend.

16 Claims, 11 Drawing Sheets

(56) References Cited

U.S. PATENT DOCUMENTS 5,360,255 A * 11/1994 Cook ..... A47C 1/0355 297/68
5,588,710 A * 12/1996 Wiecek ..... A47C 1/0355 297/85 L
5,800,010 A * 9/1998 May ..... A47C 1/0355 297/84
5,823,614 A * 10/1998 Johnson ..... A47C 1/0352 297/84 X
5,971,475 A * 10/1999 Lawson ..... A47C 1/0355 297/68
5,975,627 A * 11/1999 LaPointe et al. .... A47C 1/0355 297/83 X
6,540,291 B2 * 4/2003 Hoffman ..... A47C 1/03255 297/84
6,729,686 B2 * 5/2004 May ..... A47C 1/0355 297/84
6,793,279 B2 * 9/2004 Hoffman ..... G06F 17/142 297/84 X
7,261,367 B2 * 8/2007 Duncan ..... A47C 1/0352 297/83 X
7,445,279 B2 * 11/2008 Crum ..... A47C 1/0355 297/84 X
7,669,921 B2 * 3/2010 Hoffman ..... A47C 1/037 297/84 X
7,762,625 B2 * 7/2010 Hoffman ..... A47C 1/0355 297/84 X
8,590,964 B2 * 11/2013 Murphy ..... A47C 1/037 297/84
8,622,467 B2 * 1/2014 Murphy ..... A47C 1/037 297/83
9,356,857 B1 * 5/2016 Narayanan ..... H04L 45/302
9,357,847 B2 * 6/2016 Murphy ..... A47C 1/0242
9,603,453 B2 * 3/2017 Hoffman ..... A47C 1/0355
9,845,852 B2 * 12/2017 Lawson ..... F16H 25/20
2003/0057743 A1 * 3/2003 May ..... A47C 1/0355 297/84
2006/0290174 A1 * 12/2006 Hoffman ..... A47C 1/0355 297/84
2008/0150329 A1 * 6/2008 Lawson ..... A47C 1/0355 297/84
2009/0174251 A1 * 7/2009 Lawson ..... A47C 1/0355 297/85 R
2010/0072805 A1 * 3/2010 Qiu ..... A47C 1/0355 297/84 X
2010/0127555 A1 * 5/2010 Hoffman ..... A47C 1/0355 297/84 X
2010/0127556 A1 * 5/2010 Hoffman ..... A47C 1/0355 297/84 X
2011/0175404 A1 * 7/2011 Lawson ..... A47C 1/0355 297/83 X
2011/0175426 A1 * 7/2011 Lawson ..... A47C 1/0355 297/84 X
2011/0233972 A1 * 9/2011 Weicek ..... A47C 1/0342 297/84
2011/0304193 A1 * 12/2011 Murphy ..... A47C 1/034 297/84 X
2012/0049606 A1 * 3/2012 Lawson ..... A47C 1/0355 297/84 X
2012/0104827 A1 * 5/2012 Murphy ..... A47C 1/0345 297/84 X
2012/0112519 A1 * 5/2012 Murphy ..... A47C 1/0355 297/84 X
2012/0146364 A1 * 6/2012 Hoffman ..... A47C 1/03266 297/84
2012/0299363 A1 * 11/2012 Crum ..... A47C 1/0355 297/84 X
2013/0038095 A1 * 2/2013 Lawson ..... A47C 1/035 297/83
2013/0175847 A1 * 7/2013 Lawson ..... A61G 5/14 297/84 X
2013/0200658 A1 * 8/2013 Hoffman ..... A47C 1/0342 297/84 X
2013/0200659 A1 * 8/2013 Hoffman ..... A47C 1/035 297/84
2014/0333099 A1 * 11/2014 Lu ..... A47C 1/0355 297/83
2015/0282619 A1 * 10/2015 Lawson ..... A47C 1/0355 297/83
2016/0029800 A1 * 2/2016 Bryant ..... A47C 1/034 297/284.3
2016/0045031 A1 * 2/2016 Lawson ..... A47C 1/0345 297/284.3
2018/0027967 A1 * 2/2018 Lawson ..... A47C 1/0355
2018/0027968 A1 * 2/2018 Lawson ..... A47C 1/03211

* cited by examiner

HIGH-LEG HIDDEN OTTOMAN RECLINER SEATING MECHANISM

TECHNICAL FIELD

Embodiments of the present invention relate to recliner seating mechanisms and chairs using them, and particularly to a recliner seating mechanism for use on a chair with a high-leg design, and an ottoman that is hidden from view when in a stored position.

BACKGROUND OF THE INVENTION

One design of chairs using a reclining mechanism is known as a high-leg design. In these types of chairs, the legs suspend the seat above a flooring surface such that one can see under the chair. In a chair having this styling, the ottoman is stored in a more-horizontal position (as opposed to a vertical position). One common problem of reclining mechanisms used with chairs of this styling is that the ottoman can drop relative to an ideal stored position. The weight of the upholstered footrest can cause the footrest to sag, resulting in an appearance of the chair that is less than ideal. The initial movement from a stored to a TV position of the ottoman in these types of mechanisms is downward, which allows the weight of the ottoman to cause sagging over time. This unwanted sagging increases with thicker, heavier footrests, and also with time as the more play enters the mechanism as the pivoting joints wear.

BRIEF DESCRIPTION OF THE INVENTION

A chair mechanism is provided for a seating unit that has two sides, a seat between the two sides, an extendable ottoman and a chair back. The mechanism moves the seating unit between closed, extended and fully reclined positions. The mechanism includes a seat link and a footrest that is moveable between a closed position and an extendable position. The footrest linkage includes first, second, third and fourth footrest links. The first footrest link is pivotally coupled on a first end to the footrest. The second end of the second footrest link is also pivotally coupled to the footrest. The first end of the third footrest link is pivotally coupled the seat link and the second end is pivotally coupled to the second end of the second footrest link. The third footrest link is also pivotally coupled to the first footrest link between the first and second ends of the first footrest link. The first end of the fourth footrest link is pivotally coupled to the seat link and the second end of the fourth footrest link is pivotally coupled to the second end of the second footrest link. A first end of a footrest drive link is pivotally coupled to the fourth footrest link between the first and second end of the fourth footrest link at a point below a line intersecting the pivotal connection of the first end of the fourth footrest link to the seat link and the pivotal connection of the second end of the fourth footrest link to the first footrest link, when the footrest linkage is in a closed position. The pivotal coupling of the second end of the fourth footrest link to the second end of the first footrest link is further from the pivotal connection of the first end of the third footrest link to the seat plate than the pivotal connection of the first footrest link to the third footrest link. This geometry causes the second end of the first footrest link to rotate faster than the pivotal connection of the first footrest link to the third footrest link as the footrest linkage initially moves from the closed position towards the extended position. This in turn causes the first end of the first footrest link to move initially upward as the footrest linkage initially moves from the closed position towards the extended position. This geometry prevents the footrest from sagging over time and use.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Embodiments of the present invention generally relate to a seating unit having a mechanism usable on a high-leg styled chair that keeps the footrest assembly in a closed condition until an over-coming force is applied. The seating unit has two sides, a seat between the two sides, an extendable ottoman and a chair back. The mechanism moves the seating unit between closed, extended and fully reclined positions. The mechanism includes a seat link and a footrest that is moveable between a closed position and an extendable position. The footrest linkage includes first, second, third and fourth footrest links. The first footrest link is pivotally coupled on a first end to the footrest. The second end of the second footrest link is also pivotally coupled to the footrest. The first end of the third footrest link is pivotally coupled the seat link and the second end is pivotally coupled to the second end of the second footrest link. The third footrest link is also pivotally coupled to the first footrest link between the first and second ends of the first footrest link. The first end of the fourth footrest link is pivotally coupled to the seat link and the second end of the fourth footrest link is pivotally coupled to the second end of the second footrest link. A first end of a footrest drive link is pivotally coupled to the fourth footrest link between the first and second end of the fourth footrest link at a point below a line intersecting the pivotal connection of the first end of the fourth footrest link to the seat link and the pivotal connection of the second end of the fourth footrest link to the first footrest link, when the footrest linkage is in a closed position. The pivotal coupling of the second end of the fourth footrest link to the second end of the first footrest link is further from the pivotal connection of the first end of the third footrest link to the seat plate than the pivotal connection of the first footrest link to the third footrest link. This geometry causes the second end of the first footrest link to rotate faster than the pivotal connection of the first footrest link to the third footrest link as the footrest linkage initially moves from the closed position towards the extended position. This in turn causes the first end of the first footrest link to move initially upward as the footrest linkage initially moves from the closed position towards the extended position. This geometry prevents the footrest from sagging over time and use.

Figure 1:
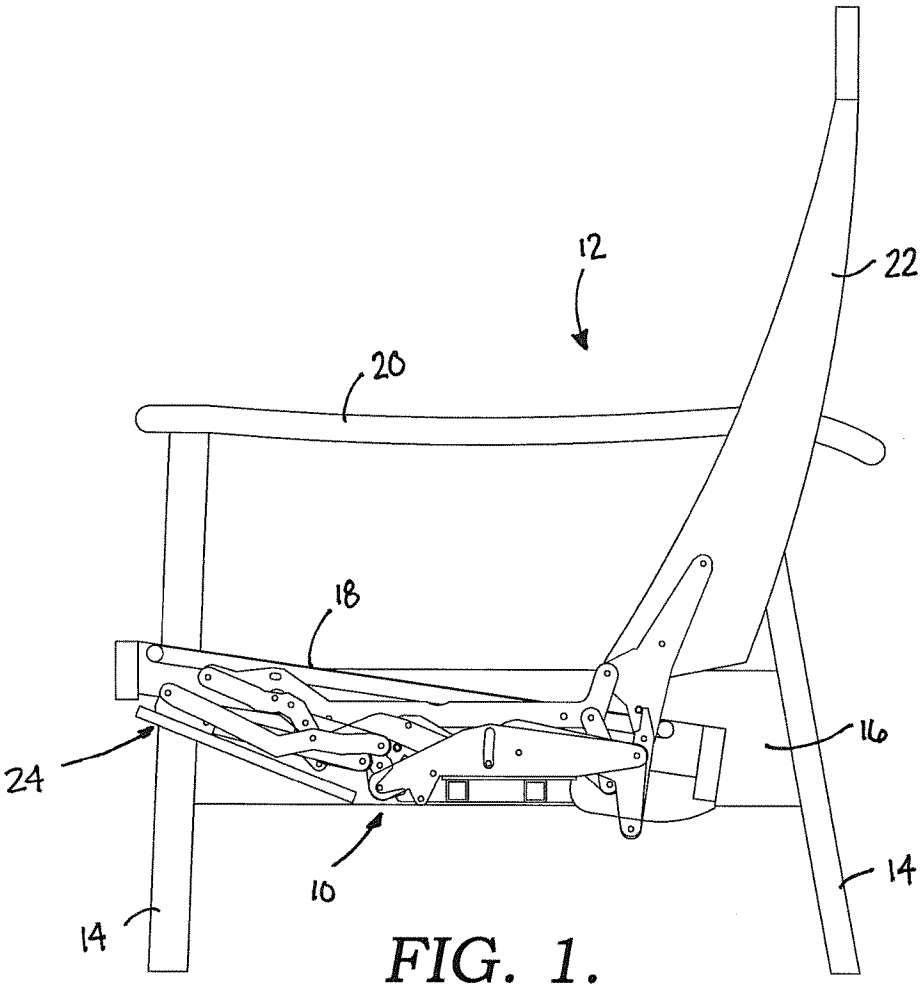
FIG. 1 is a cross sectional view of an exemplary chair with a mechanism in a closed position, showing one side of a mechanism, in accordance with an embodiment of the invention.
Figure 2:
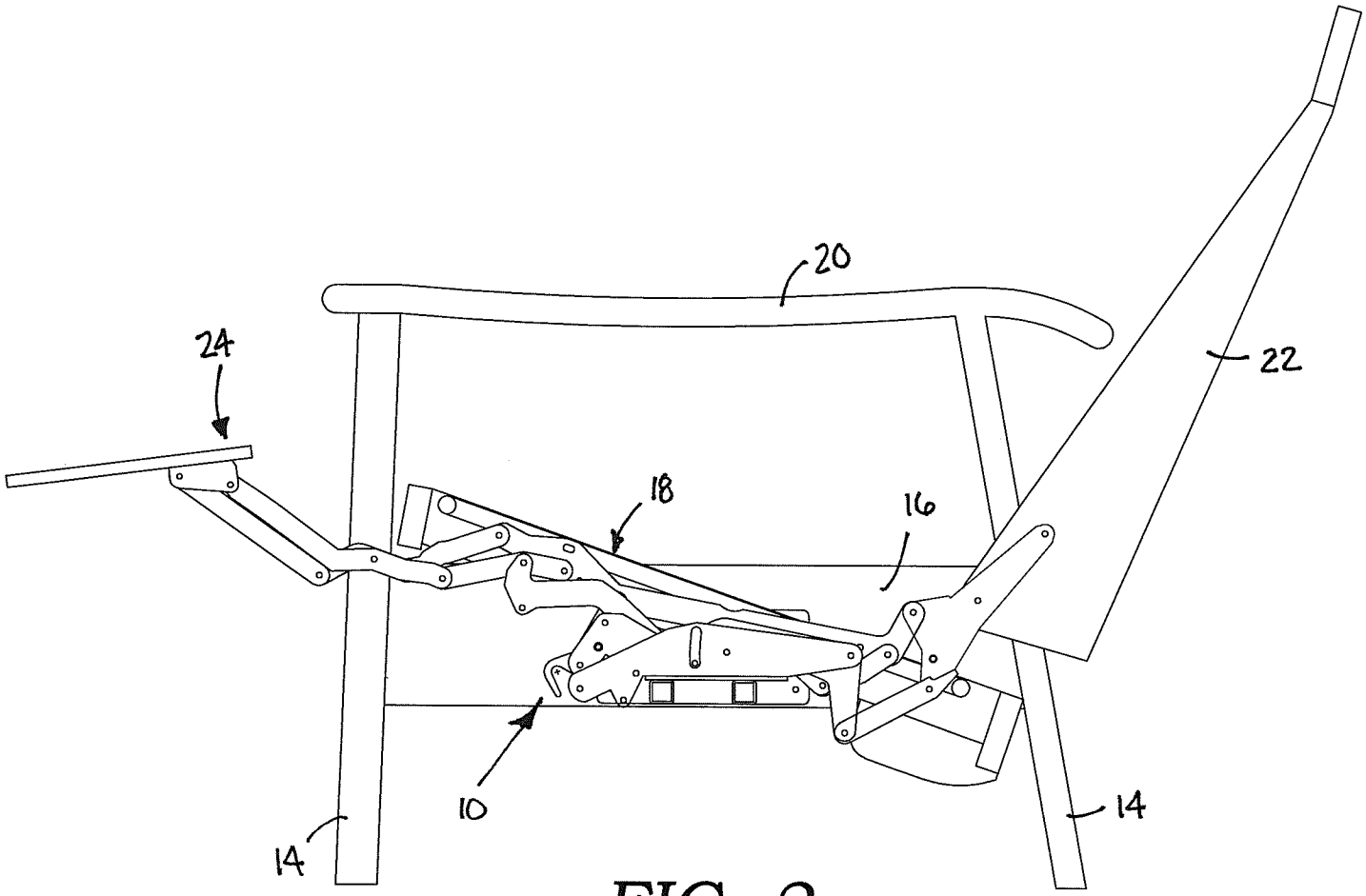
FIG. 2 is a view similar to FIG. 1, but showing the chair in the TV or extended position.

An exemplary seating mechanism 10 is shown in a cross-section of a chair 12 in a closed position in FIG. 1. The chair 12, in some aspects, has legs 14, a side frame 16 that cooperates with the mechanism 10 to support a seat 18 above the floor or other support surface. The chair 12 also arms 20 that, in some embodiments are integrally formed with the legs 14. The mechanism 10 allows the chair 12 to use what is known as "high-leg" styling, while at the same time allowing the chair 12 to move between the closed position of FIG. 1, to the extended position of FIG. 2, to the fully reclined position of FIG. 3. In the extended position of FIG. 2, a back 22 remains in a generally upright position, but a footrest assembly 24 moves from a stowed position as shown in FIG. 1 to an extended position as shown in FIG. 2. The seat 18 moves rearward and the seat 18 inclines from the back of the seat 18 to the front of the seat 18 in the extended position of FIG. 2. In the fully reclined position of FIG. 3, the back 22 reclines relative to the seat 18, the footrest assembly 24 remains extended, and the seat 18 moves farther rearward, with the angle of incline for seat 18 increasing.

For simplicity, the mechanism 10 is shown in FIGS. 4-7 without the chair 12. The mechanism 10 includes a chassis link 26 that is coupled to a corresponding side frame 16. The first end of the chassis link 26 has a pin 30 that is rigidly coupled to the chassis link 26 and extends from the chassis link 26. Similarly, the chassis link 26 has a pin 30 that is rigidly coupled to the chassis link 26 near the first end of the chassis link 26. The pin 30 also extends from the chassis link 26. In some aspects, the chassis link 26 may have a spring connection point 32 generally between and below the pin 28 and the pin 30. The spring connection point 32 could simply be a hole in chassis link 26 or could also be a pin on which to secure a spring. An arcuate slot 34 is formed in chassis link 26 generally mid-way along the length of the chassis link.

Figure 6:
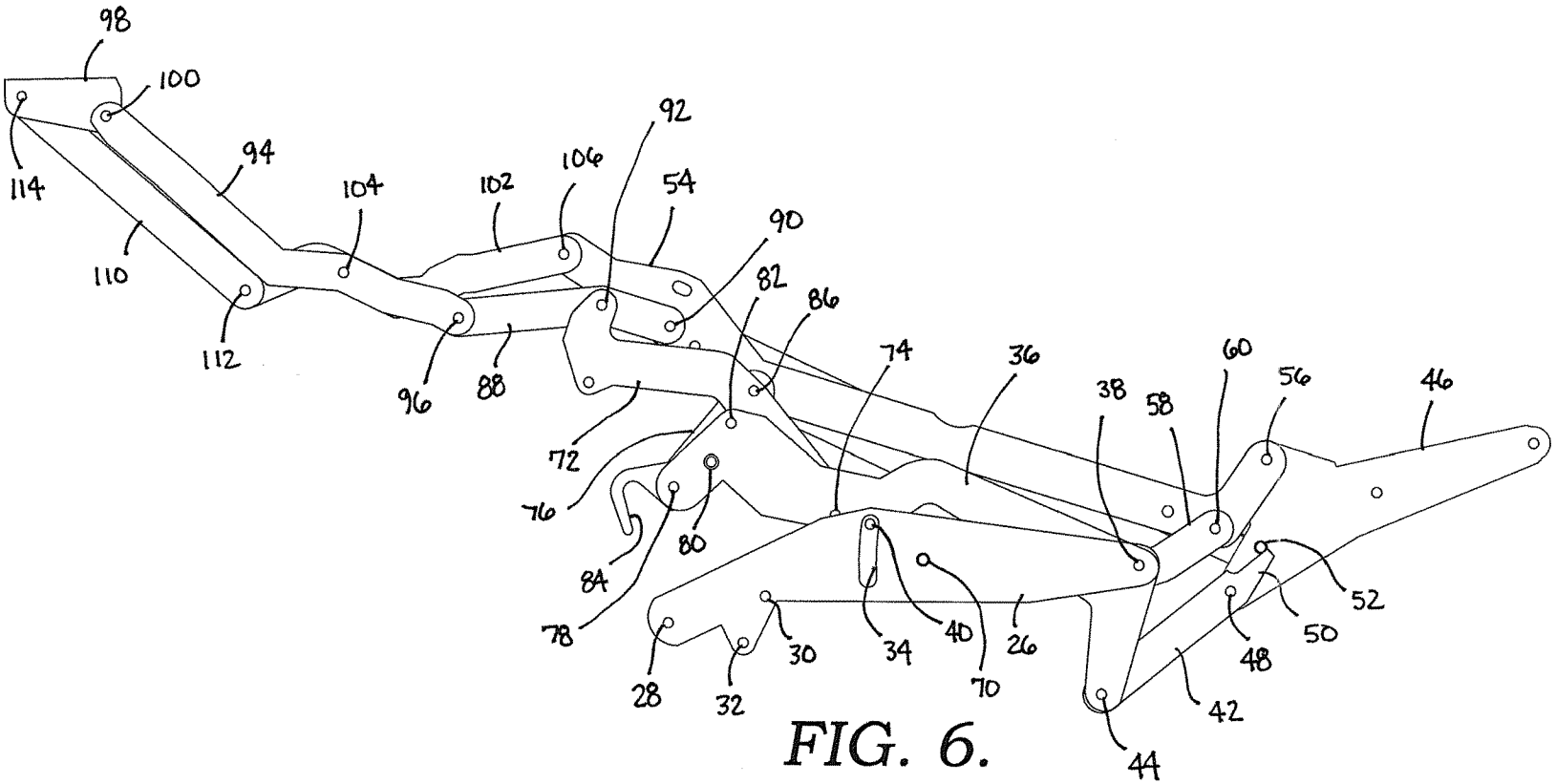
FIG. 6 is a view of the mechanism of FIG. 3 in the fully reclined position.
Figure 7:
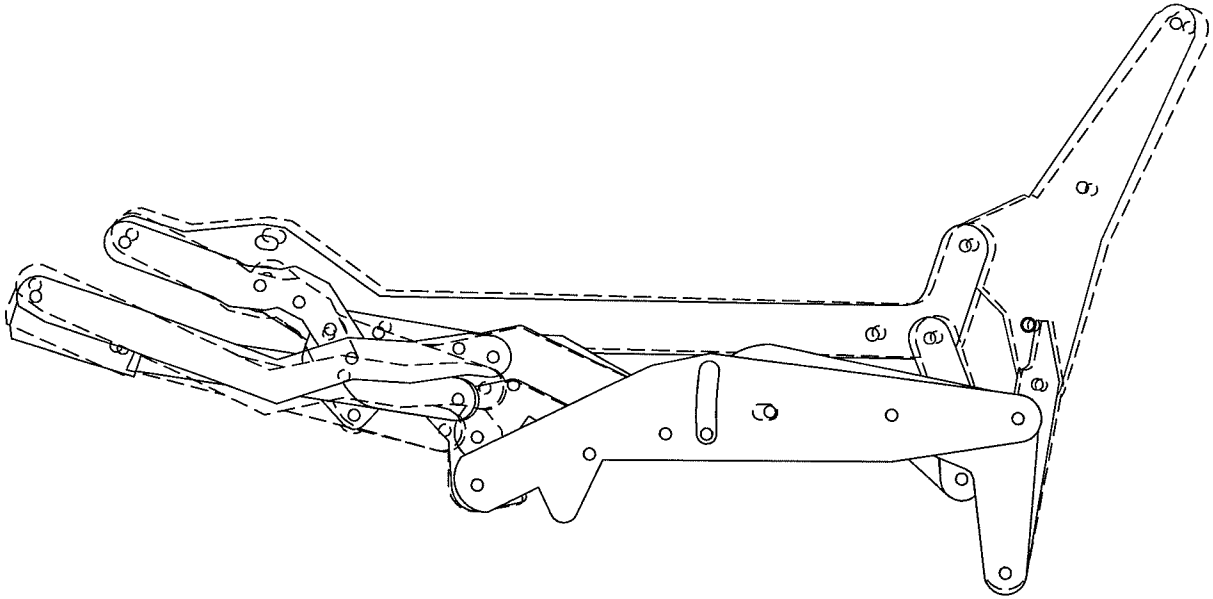
FIG. 7 is a view similar to FIG. 3, showing an initial movement of the mechanism from the closed position in dotted lines.
Figure 8A:
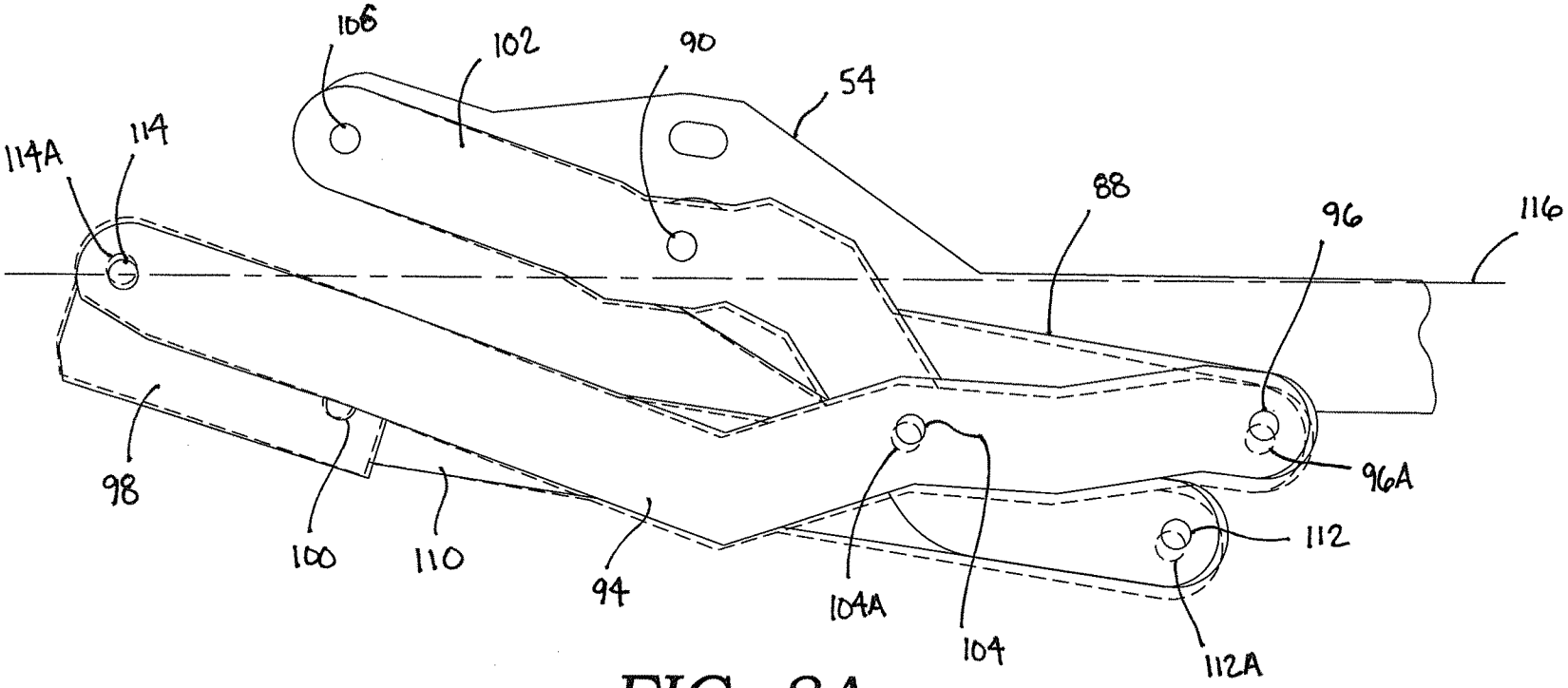
FIGS. 8A-D are a series of views showing only certain components of the mechanism in the initial movement of the mechanism from the closed position.
Figure 8B:
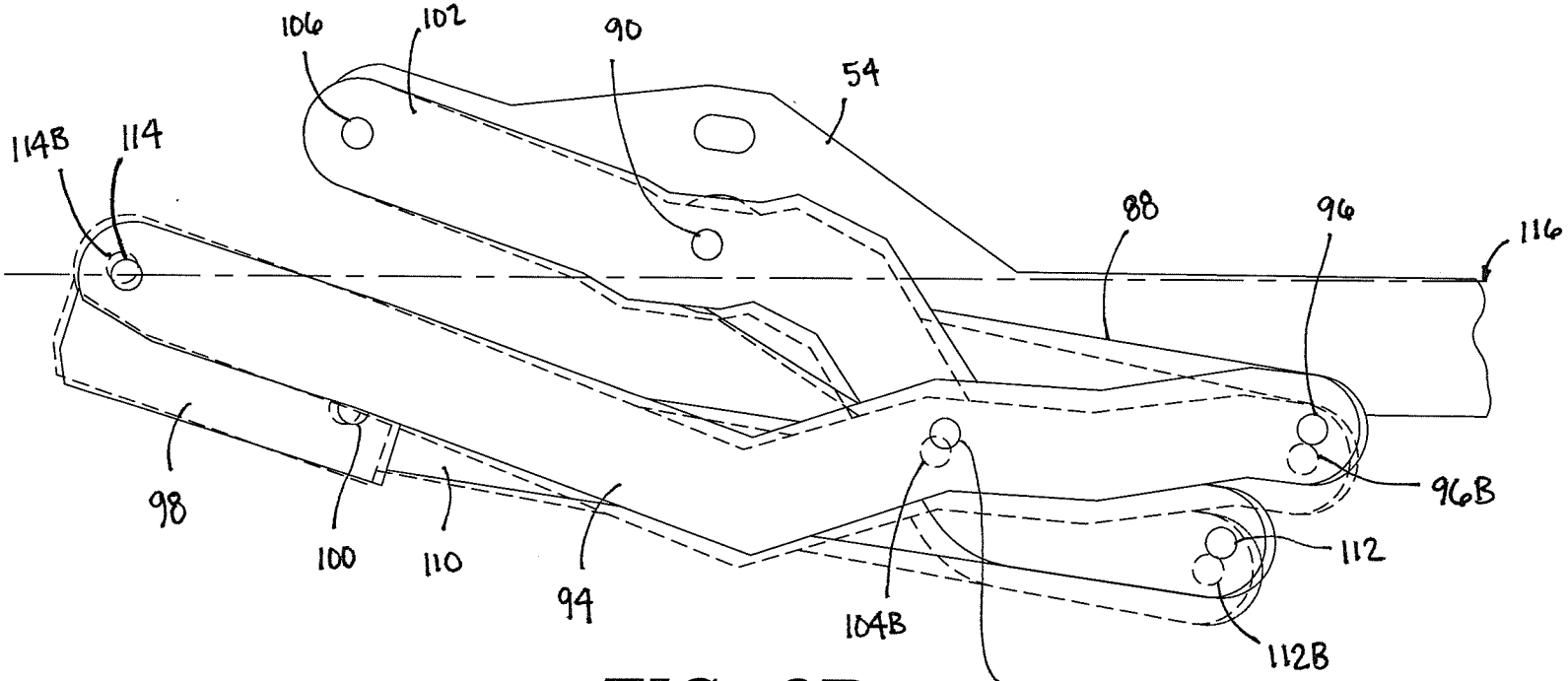
Figure 8C:
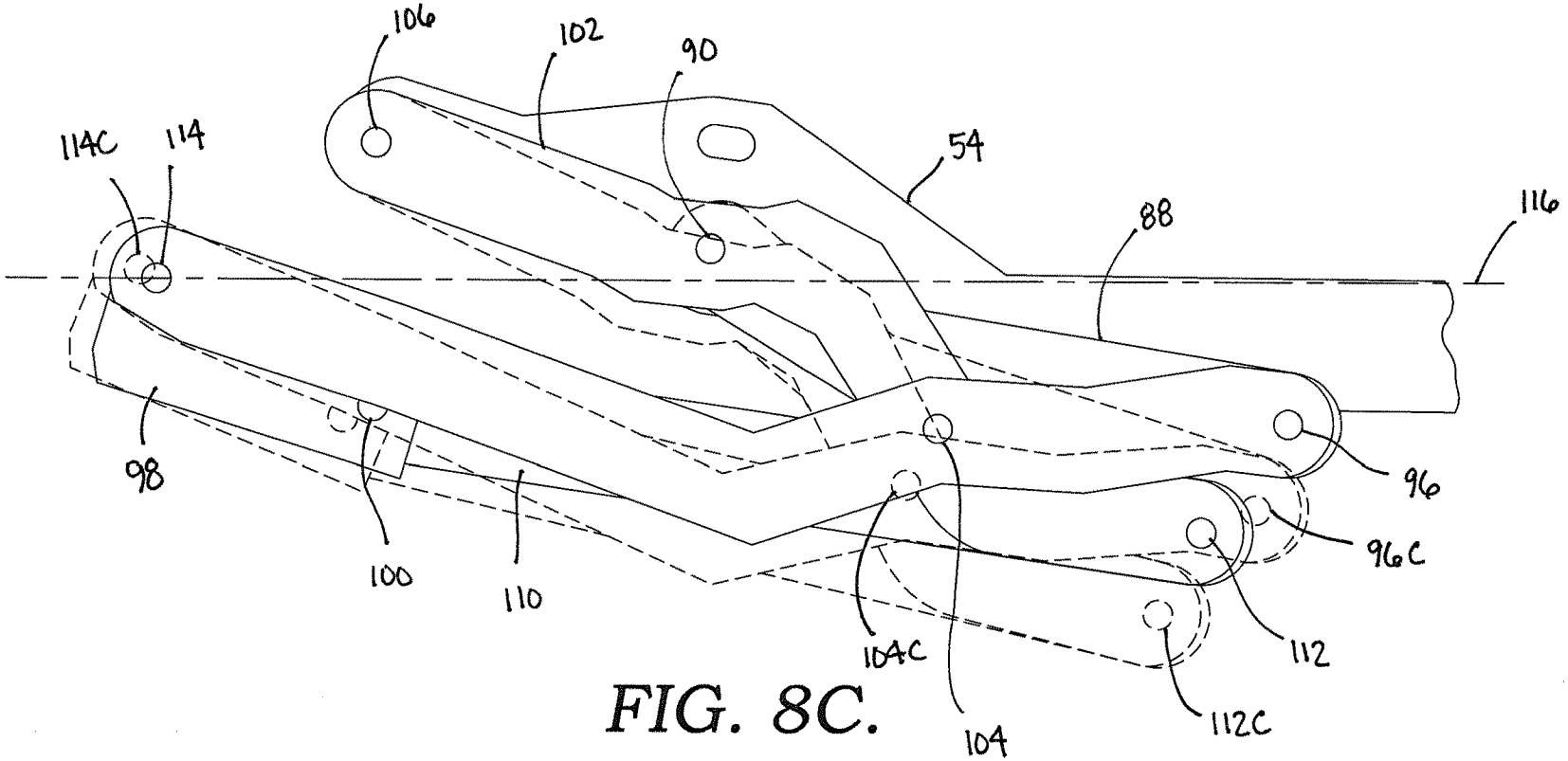
Figure 8D:
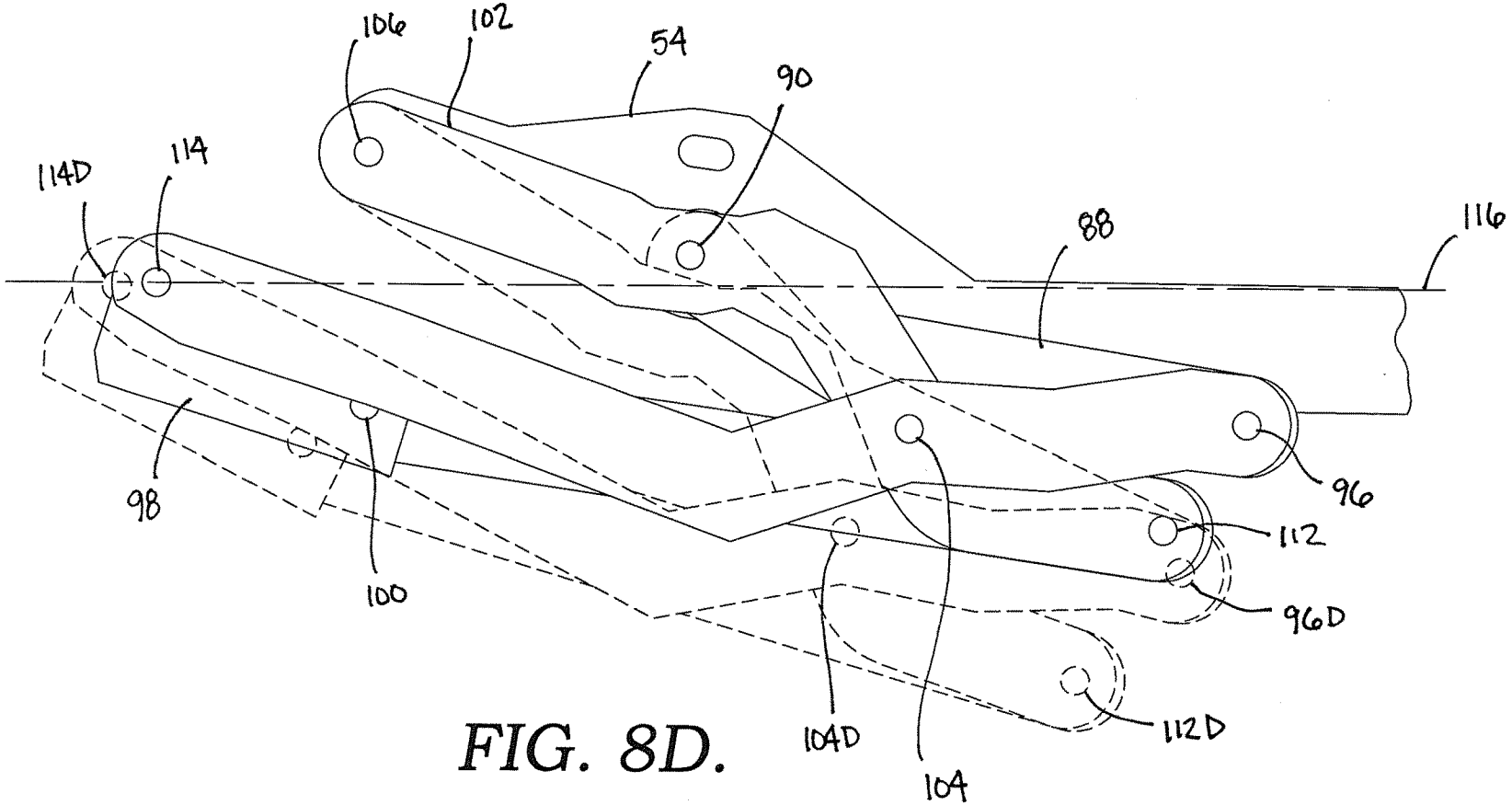

A recline tilt link 36 is pivotally coupled to a second end of chassis link 26 at pivot point 38. The recline tilt link 36 is shaped as best seen in FIG. 6. The pivotal movement of recline tilt link 36 relative to chassis link 26 is controlled and constrained by a rivet 40 (or other connector) that couples recline tilt link 36 to chassis link 26 at arcuate slot 34. Rivet 40 allows recline tilt link 36 to rotate from a lower position, with rivet 40 at the bottom of slot 34, to a raised position when the mechanism 10 is in a fully reclined position and the rivet 40 is at the top of slot 34.

Below pivot point 38, a back pivot link 42 is pivotally coupled to recline tilt link 36 at pivot point 44. Back pivot link 42 extends upwardly from pivot point 44 and is pivotally coupled on its other end to a back link 46 at pivot point 48. Back link 46 has a generally triangular shape and is used to couple back 22 to mechanism 10 as would be known to those of skill in the art. Back pivot link 42 has a retaining finger 50 that extends beyond pivot point 48. Retaining finger 50 engages a stop stud 52 that is fixedly coupled to back link 46 and that extends from back link 46 both when mechanism is in the closed position of FIG. 4 and the fully reclined position of FIG. 6 to provide added stability.

A seat link 54 is pivotally coupled to a forward, lower end of back link 46 at pivot point 56. Seat link 54 carries and supports seat 18. Below pivot point 56, a rear pivot link 58 is pivotally coupled to seat link 54 at pivot point 60. Rear pivot link 58 extends away from pivot point 60 with a slight bend in the middle, and is pivotally coupled to a recline pivot link 62 at pivot point 64. Recline pivot link 62 is also pivotally coupled to recline tilt link 36 near the midpoint of recline pivot link 62 at pivot point 66. At this midpoint, recline tilt link has a slight bend. The end of recline pivot link 58 opposite pivot point 64 has a slot 68 that is used to couple recline pivot link 58 to chassis link 26 with a rivet 70. The slotted connection provided by slot 68 and rivet 70 allows recline pivot link 62 to pivot about pivot point 66 as can best be seen by comparing FIG. 4 and FIG. 6.

Near rivet 40, a footrest drive link 72 is pivotally coupled on one end to recline tilt link 36 at pivot point 74. Staying with recline tilt link 36, a front pivot link 76 is pivotally coupled to the forward end of recline tilt link 36 at pivot point 78. Near pivot point 78, a stud 26 is fixedly coupled to recline tilt link 36. Stud 26 extends outwardly away from recline tilt link 36. Above stud 26, recline tilt link 36 has a spring connection 82. As with spring connection 32, spring connection 82 can simply a hole in recline tilt link 36 or could be a stud extending from recline tilt link 36.

Front pivot link 76 is pivotally coupled to recline tilt link 36 at pivot point 78, as noted above. Front pivot link 76 has a lower end with a hook end 84 near pivot point 78. When mechanism 10 is in the closed position, hook end 84 of front pivot link 76 engages with pin 28 on chassis link 26 to hold the various links in mechanism 10 and prevent unwanted movement of mechanism 10. The end of front pivot link 76 opposite hook end 84 is pivotally coupled to seat link 54 at pivot point 86.

Figure 3:
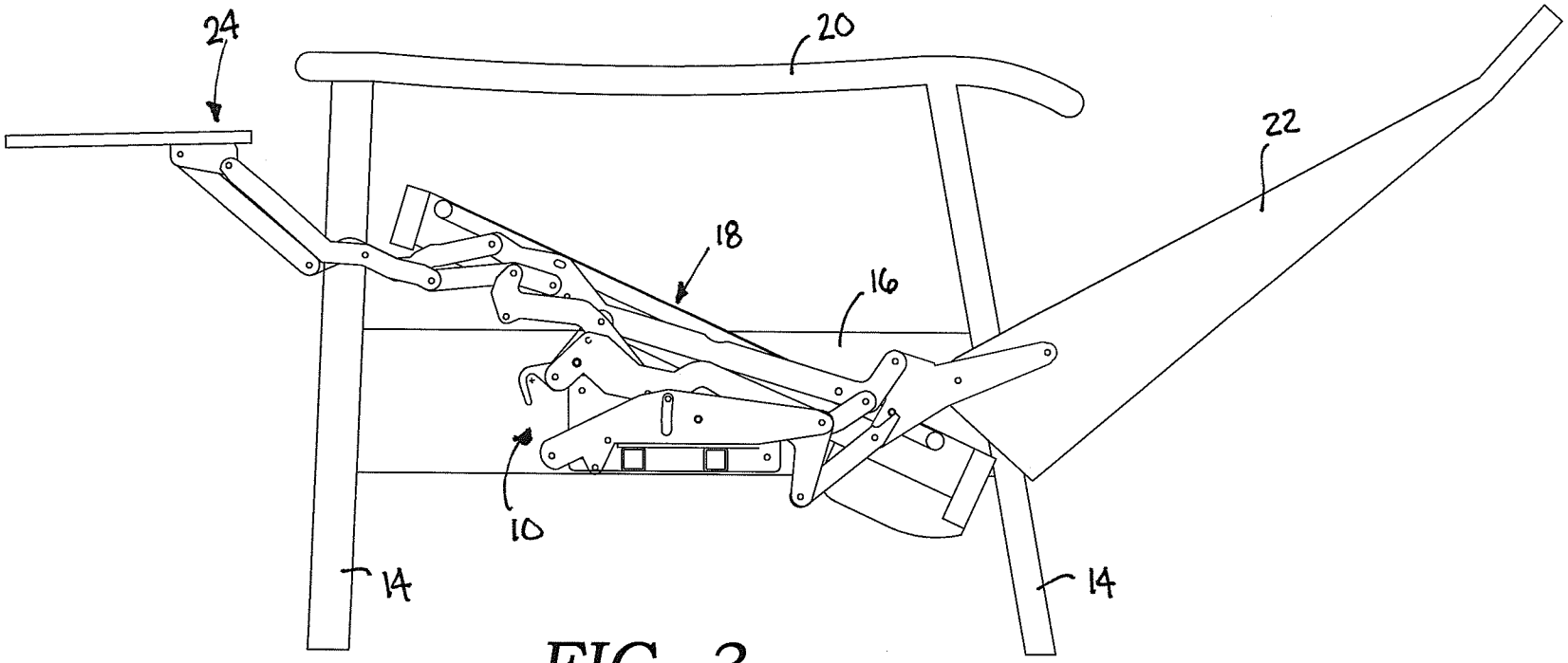
FIG. 3 is a view similar to FIG. 2, but showing the chair in the fully reclined position.
Figure 4:
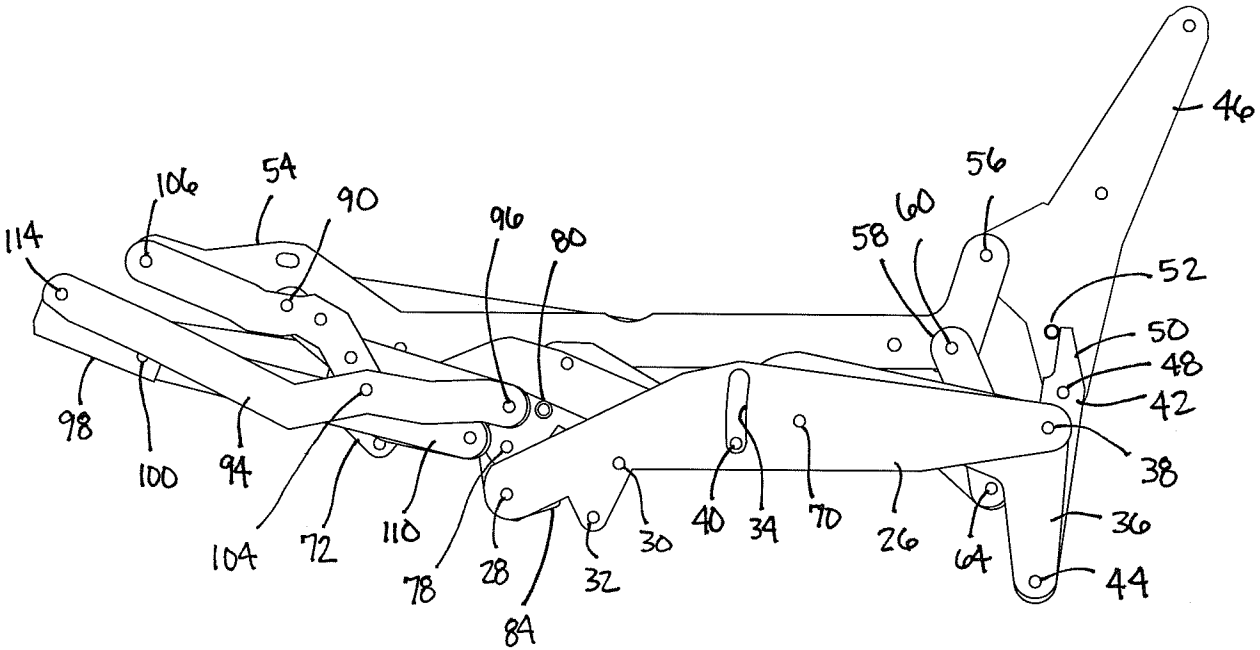
FIG. 4 is a view of the similar to FIG. 3, but showing the only the mechanism in the closed position.
Figure 5:
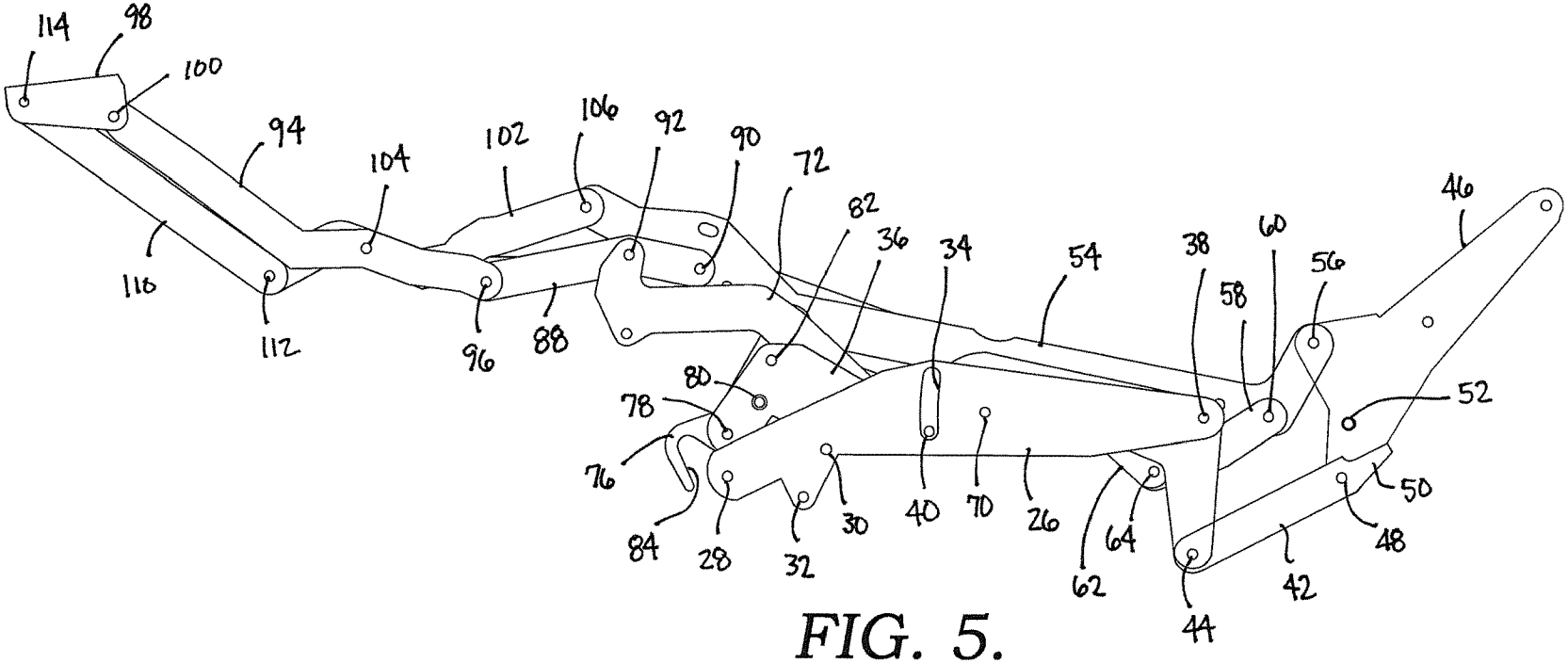
FIG. 5 is a view of the mechanism of FIG. 4 in the TV position.

The end of footrest drive link 72 opposite pivot point 74 is pivotally coupled to a fourth footrest link 88 generally midway between a first end of fourth footrest link 88 and a second end of fourth footrest link 88 at pivot point 92. Footrest drive link 72 is shaped as best seen in FIGS. 3 and 6 and is pivotally coupled to recline tilt link 36, front pivot link 76 and fourth footrest link 88. The first end of fourth footrest link 88 is pivotally coupled to seat link 54 at pivot point 90. The second end of fourth footrest link 88 is pivotally coupled to a first footrest link 94 at a pivot point 96. The end of first footrest link 94 opposite pivot point 96 is pivotally coupled to a footrest bracket 98 at pivot point 100. A third footrest link 102 of footrest assembly 24 is pivotally coupled to first footrest link 94 at pivot point 104. A first end of third footrest link 102 is pivotally coupled to seat link 54 at pivot point 106. Footrest assembly 24 also includes a second footrest link 110 that is pivotally coupled to third footrest link 102 at pivot point 112. The end of second footrest link 110 opposite pivot point 112 is pivotally coupled to footrest bracket 98 at pivot point 114.

To transition the mechanism 10, and chair 12 from the closed position of FIG. 1 to the extended position of FIG. 2, a user will exert a force on arms 20. This force on arms 20 causes seat link 54 to move rearwardly, rotating front pivot link 76 clockwise about pivot point 78 and rear pivot link 58 clockwise about pivot point 64. This moves seat link 54 rearwardly, and drops the rear of seat 18 relative to the front of seat 18. In other words, the seat 18 is inclined from back to front. The hook end 84 of front pivot link 76 disengages from pin 28 during this opening movement. As explained more-fully below, footrest drive link 72 rotates about pivot point 74 to extend the footrest assembly 24 from the closed position to the extended position, acting on fourth footrest link 88. To move from the extended position of FIG. 2 to the fully reclined position of FIG. 3, further force on the arms 18 further rotates seat link 54, and causes recline tilt link 36 to rotate about pivot point 38. This rotational movement is controlled and constrained by rivet 40 in slot 34 on chassis link 26. As recline tilt link 36 rotates, back pivot link 42 exerts a rotational force on back link 46 about pivot point 56, causing the back 22 to recline relative to seat 18. As the mechanism 10 moves from fully reclined to closed, this process reverses. Note that recline tilt link 36 will rotated about pivot point 38 until recline tilt link 36 contacts pin 30 on chassis link 26, causing footrest drive link 72 to begin closing footrest assembly 24 as the mechanism moves from the extended position to the closed position.

FIGS. 8A through 8D show a progression of the links and pivot points of footrest assembly 24 as the footrest assembly 24 is initially moving from the closed position to the extended position, and illustrate how pivot point 114 moves initially upward, before moving downward. As seen in FIGS. 8A through 8D, a reference line 116 is shown merely for a static reference line as a comparison point as the links of footrest assembly 24 move. The links shown in solid lines show the closed positions, and each successive FIG. from 8A through 8D illustrate the initial, incremental movement of footrest assembly 24 as it begins moving to the extended position in dashed lines. As can be seen, pivot points 106, 90 and 96 are generally in alignment in the fully-closed position. This geometry makes fourth footrest link 94 function as if it were a link from pivot point 106 to pivot point 96. Additionally, pivot point 96 is farther from pivot point 106 than is pivot point 104. It can be seen by comparing FIGS. 8A and 8B, or 8B and 8C, that pivot point 96 rotates a greater amount than does pivot point 104. The pivot points in the rotated location are labeled with a suffix A, B, C or D to better indicate the moved location corresponding to the figure. This means that first footrest link 94 is rotating (as viewed in the FIGS. 8A-8C) in a clockwise direction. This clockwise rotation of first footrest link 94 causes pivot point 114 to move upward as the footrest assembly 24 is in the initial stages of opening. As can be seen by comparing FIG. 8C to FIG. 8D, at some point in the opening movement, pivot point 114 will begin to drop as the footrest assembly 24 continues the opening motion. Because the initial movement of pivot point 114 is upward, a user must provide a force on the arms 20 to move seat link 54 rearwardly enough to move footrest assembly 24 past this point of upward movement. The length of front pivot link 76 allows this movement to be a smooth opening, with the user having to provide an opening force without the opening force providing an obstacle to the user in moving from the closed to the extended position.

Because the initial movement of the footrest assembly 24 from the closed to the extended position causes pivot point 114 to move upwardly, pivot point 114 and footrest bracket 98 are prevented from sagging in the closed position. This allows the footrest bracket 98 to be positively maintained in close proximity to a lower end 118 of the front of seat 18.

As the mechanism 10 moves from the extended position to the closed position, footrest drive link 72 rotates about pivot point 74 in a counter-clockwise direction (again, as viewed from the perspective of the FIGS.). During this rotation, and before the mechanism 10 moves to the fully closed position, footrest drive link 72 will contact stud 80 on recline tilt link 36. The weight of the mechanism 10, and the user in chair 12, will act on footrest drive link 72 causing the continued rotational force about pivot point 74. Because stud 80 prevents any further rotation, footrest drive link 72 will create an upward (clockwise) force at pivot point 92. This force assists fourth footrest link 88 in rotating (about pivot point 90) to the fully closed position. This is important in the high-leg, hidden ottoman styling, because a user sitting in chair 12 will not be able to provide a closing force using their feet or lower legs against the footrest assembly 24, once the footrest assembly 24 reaches a vertical position. In other words, some assist is needed to move the footrest assembly 24 to the fully closed position.

If needed, for heavier footrests, or merely as a design choice, a spring can be added between sprint connection 32 and spring connection 82.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A mechanism for a seating unit having two sides, a seat between the two sides, an extendable ottoman and a chair back, the mechanism adapted to move the seating unit between closed, extended and fully reclined positions, the mechanism comprising:

a seat link;

a footrest linkage moveable between a closed position and an extended position, the footrest linkage having;

a first footrest link having first and second ends, the first footrest link pivotally coupled on the first end to a footrest;

a second footrest link having first and second ends, the second footrest link pivotally coupled on a first end to a footrest;

a third footrest link having first and second ends, the first end of the third footrest link pivotally coupled to the seat link and the second end pivotally coupled to the second end of the second footrest link, the third footrest link also being pivotally coupled to the first footrest link between the first and second ends of the first footrest link; and a fourth footrest link having first and second ends, the first end of the fourth footrest link pivotally coupled to the seat link and the second end of the fourth footrest link pivotally coupled to the second end of the first footrest link, wherein the pivotal coupling of the second end of the fourth footrest link to the second end of the first footrest link is further from the pivotal connection of the first end of the third footrest link to the seat plate that the pivotal connection of the first footrest link to the third footrest link causing the second end of the first footrest link to rotate faster than the pivotal connection of the first footrest link to the third footrest link as the footrest linkage initially moves from the closed position towards the extended position, causing the first end of the first footrest link to move initially upward as the footrest linkage initially moves from the closed position towards the extended position;

a footrest drive link having first and second ends, the first end of the footrest drive link pivotally coupled to the fourth footrest link between the first and second end of the fourth footrest link at a point below a line intersecting the pivotal connection of the first end of the fourth footrest link to the seat link and the pivotal connection of the second end of the fourth footrest link to the first footrest link, when the footrest linkage is in a closed position; and a recline tilt link having first and second ends, and a stud coupled to the recline tilt link near the first end of the recline tilt link and projecting therefrom, and wherein the second end of the footrest drive link is pivotally coupled to the recline tilt link between the first and second end of the recline tilt link, and wherein, in the closed position, the footrest drive link abuts the stud causing a rotational force on the footrest drive link, and a corresponding upward force on the fourth footrest link at the pivotal connection of the first end of the footrest drive link and the fourth footrest link.

2. The mechanism of claim 1, wherein the pivotal connection of the footrest drive link and the fourth footrest link is below a line intersecting the pivotal connection of the first end of the fourth footrest link and the seat link and the pivotal connection of the second end of the fourth footrest link and the second end of the first footrest link, wherein the upward force exerted on the pivotal connection of the footrest drive link and the fourth footrest link caused by the rotational force of the footrest drive link contacting the stud holds the footrest linkage in a closed position.

3. The mechanism of claim 2, further comprising a chassis link coupled to one of the two sides, the chassis link having first and second ends, where the second end of the chassis link is pivotally coupled to the reclined tilt link near the second end of the recline tilt link.

4. The mechanism of claim 3, wherein the chassis link includes a curved slot extending vertically on the chassis link, and wherein the recline tilt link is coupled to the chassis link with a connector residing within the slot, the connector limiting and controlling the pivotal movement of the recline tilt link relative to the chassis link.

5. The mechanism of claim 4, further comprising a front pivot link having first and second ends, the first end of the front pivot link pivotally coupled to the seat link, and the second end of the front pivot link pivotally coupled to the recline tilt link.

6. The mechanism of claim 5, wherein the first end of the chassis link has a pin extending therefrom, and wherein the second end of the front pivot link has a hook end that engages the pin when the mechanism is in a closed position.

7. The mechanism of claim 6, further comprising a recline pivot link having first and second ends, where the first end of the recline pivot link has an elongated slot, and the first end of the recline pivot link is pivotally connected to the chassis link at the elongated slot, and where the recline pivot link is also pivotally coupled to the chassis link generally mid-way between the first end of the recline pivot link and the second end of the recline pivot link.

8. The mechanism of claim 7, further comprising a rear pivot link pivotally coupled on a first end to the seat link and pivotally coupled on a second end to the second end of the recline pivot link, wherein the front pivot link and the rear pivot link control and constrain the movement of the seat link as the mechanism moves the seating unit between closed, extended and fully reclined positions.

9. The mechanism of claim 8, further comprising a back link pivotally coupled to the seat link, and further comprising a back pivot link having first and second ends, where the first end of the back pivot link is pivotally coupled to the back link and the second end of the back pivot link is pivotally coupled to the second end of the recline tilt link.

10. A mechanism for a seating unit having two sides, a seat between the two sides, and extendable footrest and a chair back, the mechanism adapted to move the seating unit between closed, extended and fully reclined positions, the mechanism comprising:

a chassis link having a front end and a rear end, the chassis link adapted to be coupled to one of the sides;

a recline tilt link having first and second ends, the recline tilt link second end pivotally coupled to the chassis link near the rear end of the chassis link, the recline tilt link having a stud extending therefrom near the recline tilt link first end;

a footrest drive link having first and second ends, the second end of the footrest drive link pivotally coupled to the recline tilt link between the recline tilt link first end and recline tilt link second end at a point lower than the recline tilt link stud;

a seat link, having a front end and a rear end, the seat link pivotally coupled by a linkage to the chassis link;

a footrest linkage pivotally coupled to the front end of the seat plate, the footrest linkage having first and second footrest links pivotally coupled to the footrest, and third and fourth footrest links pivotally coupled to the seat link;

the first end of the footrest drive link is pivotally coupled to the fourth footrest link;

wherein, in the closed position, the footrest drive link contacts the recline tilt link stud, exerting a rotational force about the pivotal connection of the footrest drive link to the recline tilt link, which in turn exerts an opposite rotational force of the fourth footrest link about the pivotal connection to the seat link to positively maintain the footrest linkage in a closed position.

11. The mechanism of claim 10, wherein the chassis link includes a curved slot extending vertically on the chassis link, and wherein the recline tilt link is coupled to the chassis link with a connector residing within the slot, the connector limiting and controlling the pivotal movement of the recline tilt link relative to the chassis link.

12. The mechanism of claim 11, wherein the fourth footrest link has a first end and a second end, the first footrest link has a first end and a second end, and wherein the first end of the fourth footrest link is pivotally coupled to the seat link and the second end of the fourth footrest link is pivotally coupled to the second end of the first footrest link, the first end of the first footrest link being pivotally coupled to the footrest, and wherein the third footrest link has first and second ends, the first end of the third footrest link being pivotally coupled to the seat link, the second end of the third footrest link being pivotally coupled to the second footrest link, and the third footrest link being pivotally coupled to the first footrest link between the first end and the second end of the first footrest link.

13. The mechanism of claim 12, wherein the pivotal coupling of the second end of the fourth footrest link to the second end of the first footrest link is further from the pivotal connection of the first end of the third footrest link to the seat plate that the pivotal connection of the first footrest link to the third footrest link, causing the second end of the first footrest link to rotate faster than the pivotal connection of the first footrest link to the third footrest link as the footrest linkage initially moves from the closed position towards the extended position, causing the first end of the first footrest link to move initially upward as the footrest linkage initially moves from the closed position towards the extended position.

14. The mechanism of claim 13, wherein the pivotal connection of the footrest drive link and the fourth footrest link is below a line intersecting the pivotal connection of the first end of the fourth footrest link and the seat link and the pivotal connection of the second end of the fourth footrest link and the second end of the first footrest link, wherein the upward force exerted on the pivotal connection of the footrest drive link and the fourth footrest link caused by the rotational force of the footrest drive link contacting the stud holds the footrest linkage in a closed position.

15. A seating unit moveable between a closed position, an extended position and a fully reclined position, the seating unit comprising:

two spaced apart sides;

a seat extending between the two sides;

an extendable ottoman;

a chair back, and a mechanism adapted to move the seating unit between the closed, extended and fully reclined positions, the mechanism comprising;

a seat link;

a footrest linkage moveable between a closed position and an extended position, the footrest linkage having;

a first footrest link having first and second ends, the first footrest link pivotally coupled on the first end to a footrest;

a second footrest link having first and second ends, the second footrest link pivotally coupled on a first end to a footrest;

a third footrest link having first and second ends, the first end of the third footrest link pivotally coupled to the seat link and the second end pivotally coupled to the second end of the second footrest link, the third footrest link also being pivotally coupled to the first footrest link between the first and second ends of the first footrest link; and a fourth footrest link having first and second ends, the first end of the fourth footrest link pivotally coupled to the seat link and the second end of the fourth footrest link pivotally coupled to the second end of the first footrest link, wherein the pivotal coupling of the second end of the fourth footrest link to the second end of the first footrest link is further from the pivotal connection of the first end of the third footrest link to the seat plate that the pivotal connection of the first footrest link to the third footrest link, causing the second end of the first footrest link to rotate faster than the pivotal connection of the first footrest link to the third footrest link as the footrest linkage initially moves from the closed position towards the extended position, causing the first end of the first footrest link to move initially upward as the footrest linkage initially moves from the closed position towards the extended position;

a footrest drive link having first and second ends, the first end of the footrest drive link pivotally coupled to the fourth footrest link between the first and second end of the fourth footrest link at a point below a line intersecting the pivotal connection of the first end of the fourth footrest link to the seat link and the pivotal connection of the second end of the fourth footrest link to the first footrest link, when the footrest linkage is in a closed position; and a recline tilt link having first and second ends, and a stud coupled to the recline tilt link near the first end of the recline tilt link and projecting therefrom, and wherein the second end of the footrest drive link is pivotally coupled to the recline tilt link between the first and second end of the recline tilt link, and wherein, in the closed position, the footrest drive link abuts the stud causing a rotational force on the footrest drive link, and a corresponding upward force on the fourth footrest link at the pivotal connection of the first end of the footrest drive link and the fourth footrest link.

16. The mechanism of claim 15, wherein the pivotal connection of the footrest drive link and the fourth footrest link is below a line intersecting the pivotal connection of the first end of the fourth footrest link and the seat link and the pivotal connection of the second end of the fourth footrest link and the second end of the first footrest link, wherein the upward force exerted on the pivotal connection of the footrest drive link and the fourth footrest link caused by the rotational force of the footrest drive link contacting the stud holds the footrest linkage in a closed position.

* * * * *